US011297993B2

(12) United States Patent
Franke

(10) Patent No.: US 11,297,993 B2
(45) Date of Patent: Apr. 12, 2022

(54) WET-CLEANING APPARATUS FOR THE WET CLEANING OF A FLOOR SURFACE

(71) Applicant: i-mop GmbH, Bensheim (DE)

(72) Inventor: Rudolf Franke, Bensheim (DE)

(73) Assignee: i-mop GmbH, Bensheim (DE)

( * ) Notice: Subject to any disclaimer, the term of this patent is extended or adjusted under 35 U.S.C. 154(b) by 364 days.

(21) Appl. No.: 16/407,677

(22) Filed: May 9, 2019

(65) Prior Publication Data

US 2019/0343357 A1 Nov. 14, 2019

(30) Foreign Application Priority Data

May 14, 2018 (DE) ..... 10 2018 207 428.3

(51) Int. Cl.
*A47L 11/30* (2006.01)
*A47L 11/40* (2006.01)

(52) U.S. Cl.
CPC ..... *A47L 11/305* (2013.01); *A47L 11/4016* (2013.01); *A47L 11/4044* (2013.01)

(58) Field of Classification Search
CPC ..... A47L 11/305; A47L 11/4016; A47L 11/4044; A47L 11/283; A47L 11/4013
See application file for complete search history.

(56) References Cited

U.S. PATENT DOCUMENTS 9,826,874 B2 11/2017 Franke et al.
2004/0068825 A1* 4/2004 Fields ..... A47L 11/4013 15/340.4
2015/0113757 A1 4/2015 Franke et al.

FOREIGN PATENT DOCUMENTS

EP 0 448 824 A1 10/1991
EP 2 832 277 A2 2/2015
EP 3 066 971 A1 9/2016
ER 2 832 277 B1 9/2016

OTHER PUBLICATIONS

German-language European Search Report issued in counterpart European Application No. 19170616.7 dated Nov. 11, 2019 with partial English translation (eight (8) pages).

* cited by examiner

*Primary Examiner* — David Redding
(74) *Attorney, Agent, or Firm* — Crowell & Moring LLP

(57) ABSTRACT

A wet-cleaning apparatus for the wet cleaning of a floor surface includes a hand-guidance part, which is connected for pivoting articulation, about at least two joint axes, to a floor part, which in an operating state rests on the floor surface, and is in torque-transmitting operative connection with the floor part. At least one floor-treatment tool is arranged on the floor part and has two disc tools, which in the operating state rest on the floor surface, can be rotated in opposite directions by at least one drive and are arranged and/or configured such that, in the operating state, there is permanent linear propulsion along a cleaning direction onto the floor part. A suction-bar arrangement is arranged behind the floor-treatment tool, as seen in relation to the cleaning direction, and is intended for the suction removal of liquid from the floor surface. A pick-up device is arranged between the at least one floor-treatment tool and the suction-bar arrangement, as seen in the cleaning direction, and picks up and collects solid particles transported to the rear by the floor-treatment tool.

16 Claims, 6 Drawing Sheets

WET-CLEANING APPARATUS FOR THE WET CLEANING OF A FLOOR SURFACE

CROSS REFERENCE TO RELATED APPLICATIONS

This application claims priority under 35 U.S.C. § 119 from German Patent Application No. 102 018 207 428.3, filed May 14, 2018, the entire disclosure of which is herein expressly incorporated by reference.

BACKGROUND AND SUMMARY OF THE INVENTION

The invention relates to a wet-cleaning apparatus for the wet cleaning of a floor surface, having a hand-guidance part, which is connected for pivoting articulation, about at least two joint axes, to a floor part, which in an operating state rests on the floor surface, and is in torque-transmitting operative connection with the floor part, having at least one floor-treatment tool which is arranged on the floor part and has two disc tools, which in the operating state rest on the floor surface, can be rotated in opposite directions by means of at least one drive and are arranged and/or configured such that, in the operating state, there is permanent linear propulsion along a cleaning direction onto the floor part, and having a suction-bar arrangement which is arranged behind the floor-treatment tool—as seen in relation to the cleaning direction—and is intended for the suction removal of liquid from the floor surface.

Such a wet-cleaning apparatus is known in the form of a scrubbing/suction machine from EP 2 832 277 B1. The known wet-cleaning apparatus has a manual-grip hand-guidance part which is connected, by means of a joint arrangement, to a floor part, which in an operating state rests on the floor surface. The joint arrangement of the known wet-cleaning apparatus is configured such that, starting from a vertical, the hand-guidance part can be pivoted all around in all directions relative to the floor part. The joint arrangement here allows torque transmission between the hand-guidance part and the floor part for the purpose of manual control of the floor part on the floor surface. Furthermore, the known wet-cleaning apparatus has a floor-treatment tool which is arranged on the floor part and can be rotated by means of a drive. In the operating state, the floor-treatment tool rests on the floor surface and provides for permanent linear propulsion along a cleaning direction. Also provided is a suction-bar arrangement, which is arranged behind the floor-treatment tool. The suction-bar arrangement serves for the suction removal of liquid from the floor surface.

It is the object of the invention to create a wet-cleaning apparatus of the type mentioned in the introduction which provides for improved cleaning of floor surfaces.

This object is achieved by the provision of a pick-up device which is arranged between the at least one floor-treatment tool and the suction-bar arrangement, as seen in the cleaning direction, and picks up and collects the solid particles transported to the rear by the floor-treatment tool. The solution according to the invention provides for improved cleaning of the floor surface. In particular, the invention avoids the situation where solid particles transported in the direction of the suction-bar arrangement by means of the floor-treatment tool are accumulated in front of and/or beneath the suction-bar arrangement. Solid particles accumulated in this way can impair the suction action of the suction-bar arrangement. This can mean that the liquid used for the wet cleaning is unsatisfactorily removed by suction from the floor surface. This can result, in particular, in streaks forming on the floor surface which is to be cleaned, in the suction-bar arrangement tending to cause smearing and, ultimately, in sub-standard cleaning. The solution according to the invention counteracts this by the pick-up device being provided and being arranged between the floor-treatment tool and the suction-bar arrangement, as seen in the cleaning direction. The pick-up device here serves to pick up and collect the solid particles. For this purpose, the pick-up device can preferably have a pick-up container in which the solid particles are picked up and collected. As an alternative, the pick-up device can have a receiving element which can be produced, for example, in a sponge-like manner and/or from fibres and designed in the form of a cleaning fleece, of a cleaning cloth or cleaning sponge or the like. It is possible here for the receiving element to be configured such that the said solid particles are caught, and therefore received and collected, in the receiving element.

The floor-treatment tool advantageously has a three-fold function in so far as the floor-treatment tool serves to treat the floor surface, also to propel the wet-cleaning apparatus and, in addition, to transport the solid particles in the direction of the pick-up device. The floor-treatment tool preferably has at least two disc tools, in the form of disc-like brush tools, which can be rotated about spaced-apart and essentially vertically extending axes of rotation. In order to provide for the permanent linear propulsion, the axes of rotation of the brush tools are preferably in a state in which they are tilted slightly in relation to one another out of the vertical. Solid particles within the context of the invention are intended to mean, in particular, dust, hair, relatively small objects and, to that extent, sweepings and/or dirt. The directional indication "to the rear" in the present case means an orientation directed counter to the propulsion of the floor-treatment tool and therefore counter to the cleaning direction. At least part of the pick-up device is arranged between the floor-treatment tool and the suction-bar arrangement. For example, it is possible for part of the pick-up device to extend laterally around and/or vertically beyond the suction-bar arrangement. The pick-up device is preferably arranged in its entirety between the floor-treatment tool and the suction-bar arrangement, as seen in the cleaning direction. The two joint axes preferably form a double-jointed joint arrangement which is configured such that, starting from a vertical, the hand-guidance part can be pivoted all around in all directions at different angles relative to the vertical and, with angle limiting, is in torque-transmitting operative connection with the floor part in any angular position relative to the vertical.

The solution according to the invention is particularly advantageously suitable for the wet cleaning of floors indoors. Nevertheless, the solution according to the invention can also be used for the wet cleaning of floors outdoors.

One configuration of the invention provides a guide element by means of which the pick-up device is mounted in a floating manner relative to the suction-bar arrangement and/or the floor-treatment tool, as seen in the vertical direction. The guide element serves to guide the pick-up device for linear and/or pivoting movement. The guide element is preferably designed in the form of a linear guide and/or of a rotary guide. The guide element provides for movement of the pick-up device relative to the floor surface in the vertical direction. Floating mounting of the pick-up device is achieved in this way, and therefore it can be better adjusted to any unevennesses of the floor surface which is to be cleaned. This configuration of the invention provides for further-improved cleaning action.

In a further configuration of the invention, the guide element has at least one stay bolt engaging in a slot, wherein preferably the slot is formed on the pick-up device and the stay bolt is connected to the suction-bar arrangement. The stay bolt is guided in a linearly movable manner in the slot. It is possible here for the stay bolt to be elongate preferably vertically or horizontally—as seen in relation to the floor surface. Accordingly, the slot is elongate preferably horizontally or vertically.

In a further configuration of the invention, the pick-up device has a pick-up container which picks up and collects the solid particles. The pick-up container preferably has a pick-up opening, which is directed towards the floor-treatment tool in the cleaning direction and through which solid particles can pass into the interior of the pick-up container. The pick-up container preferably extends over essentially the entire width of the floor-treatment tool—as seen in relation to a transverse direction of the wet-cleaning apparatus. In order to provide for simplified removal for the purpose of emptying and cleaning the pick-up container, it is advantageous if the latter is secured in a releasable manner on the floor part and/or the suction-bar arrangement.

In a further configuration of the invention, the pick-up device has a supply element which is arranged between a pick-up opening of the pick-up container and the at least one floor-treatment tool, as seen in the cleaning direction, and supplies the solid particles to the pick-up opening. The solid particles can be supplied to the pick-up container in a specific manner by means of the supply element. For this purpose, the supply element can be designed in the form of a ramp, line, channel, funnel or the like. It is possible here for the supply element to be formed in one piece on the pick-up container or, in the form of a separately produced component, to be joined together with the pick-up container. This configuration of the invention provides for further-improved cleaning action.

In a further configuration of the invention, the supply element has a plate-form extension of the pick-up container. The extension preferably extends essentially parallel to the floor surface and, to that extent, horizontally. It is possible here for at least part of the plate-form extension to be arranged between the floor surface and the floor-treatment tool, as seen in the vertical direction. The extension serves to transport the solid particles in an improved manner in the direction of the pick-up container and therefore, in simple terms, lengthens the supply element.

In a further configuration of the invention, the pick-up device has a supporting element which supports the pick-up container, in the operating state, on the floor surface. The supporting element here serves to support the pick-up container preferably with sliding or rolling action and, to that extent, can be designed in the form of a slider, of a wheel, of a roller or the like. The supporting element provides, in particular, for improved movement capability of the pick-up device along the floor surface.

A further configuration of the invention provides a wiper element arranged on the underside of the pick-up container. The wiper element is preferably designed in the form of a sealing lip and/or of a textile sheet-like structure. The wiper element serves to provide sealing between the pick-up container and the floor surface. The wiper element therefore avoids the situation where solid particles can be transported through beneath the pick-up container and can thus pass in an undesirable manner into the region of the suction-bar arrangement.

In a further configuration of the invention, the pick-up device has at least one discharging element which discharges liquid picked up in the pick-up container. This situation where the rotating floor-treatment tool, alongside the solid particles, throws up liquid from the floor surface, it being possible for said liquid thus to pass into the pick-up container, is not readily avoidable. The discharging element is provided in order to discharge said liquid. The discharging element avoids the situation where the pick-up container overflows during the course of the wet-cleaning operation and, as a result, solid particles are washed out of the pick-up container. The discharging element preferably forms a fluid-channelling through-passage from an inner side of the pick-up container to an outer side of the pick-up container. The through-passage is dimensioned in coordination with the solid particles which are to be collected in the pick-up container, and therefore said particles cannot be washed out of the pick-up container through the through-passage.

In a further configuration of the invention, the discharging element has at least one drainage opening, which is arranged on the pick-up container, and/or one liquid-permeable drainage-wall portion of the pick-up container. The drainage opening is designed preferably in the form of at least one bore or of at least one slot. The liquid-permeable drainage-wall portion is configured preferably in the manner of a net, lattice, screen or the like.

In a further configuration of the invention, the pick-up device has a restraining element, which holds back the solid particles collected in the pick-up container. The restraining element functions, in particular, such that solid particles, once passed into the pick-up container, are reliably held back in said container during the wet-cleaning operation. The restraining element therefore counteracts the undesirable situation where solid particles exit from the pick-up container onto the floor surface which is to be cleaned.

In a further configuration of the invention, the restraining element has a restraining-wall portion of the pick-up container, said wall portion being adjacent to a pick-up opening of the pick-up container. In this configuration of the invention, the pick-up container is bordered by wall portions preferably both at laterally opposite end regions and at longitudinally opposite end regions, wherein one of said wall portions forms the restraining-wall portion. The restraining-wall portion is preferably arranged between the floor-treatment tool and a receiving space of the pick-up container as seen in the cleaning direction. This is a particularly easy-to-produce configuration of the invention.

In a further configuration of the invention, the restraining-wall portion is configured in the form of a ramp which, in the operating state, extends at an acute angle relative to the floor surface. The ramp is preferably undercut. The fact that the ramp extends at an acute angle makes it possible, in particular, for solid particles which bounce off the restraining-wall portion to be deflected advantageously downwards, in the direction of a floor surface of the pick-up container. In other words, the restraining-wall portion extends obliquely upwards counter to the cleaning direction. The ramp preferably performs a double function, in so far as a ramp region which is directed towards the floor-treatment tool can function as a supply element which supplies the solid particles to a pick-up opening of the pick-up container.

In a further configuration of the invention, the pick-up device has a receiving element, at least part of which rests, in the operating state, on the floor surface. The receiving element serves to receive and collect the solid particles. The receiving element is preferably produced from fibres and/or is of a sponge-like design. The receiving element is preferably designed in the form of a cleaning fleece or of a cleaning cloth or cleaning sponge.

Further advantages and features of the invention can be gathered from the claims and from the following description of preferred exemplary embodiments of the invention, these exemplary embodiments being illustrated with reference to the drawings.

DETAILED DESCRIPTION OF THE DRAWINGS

Figure 1:
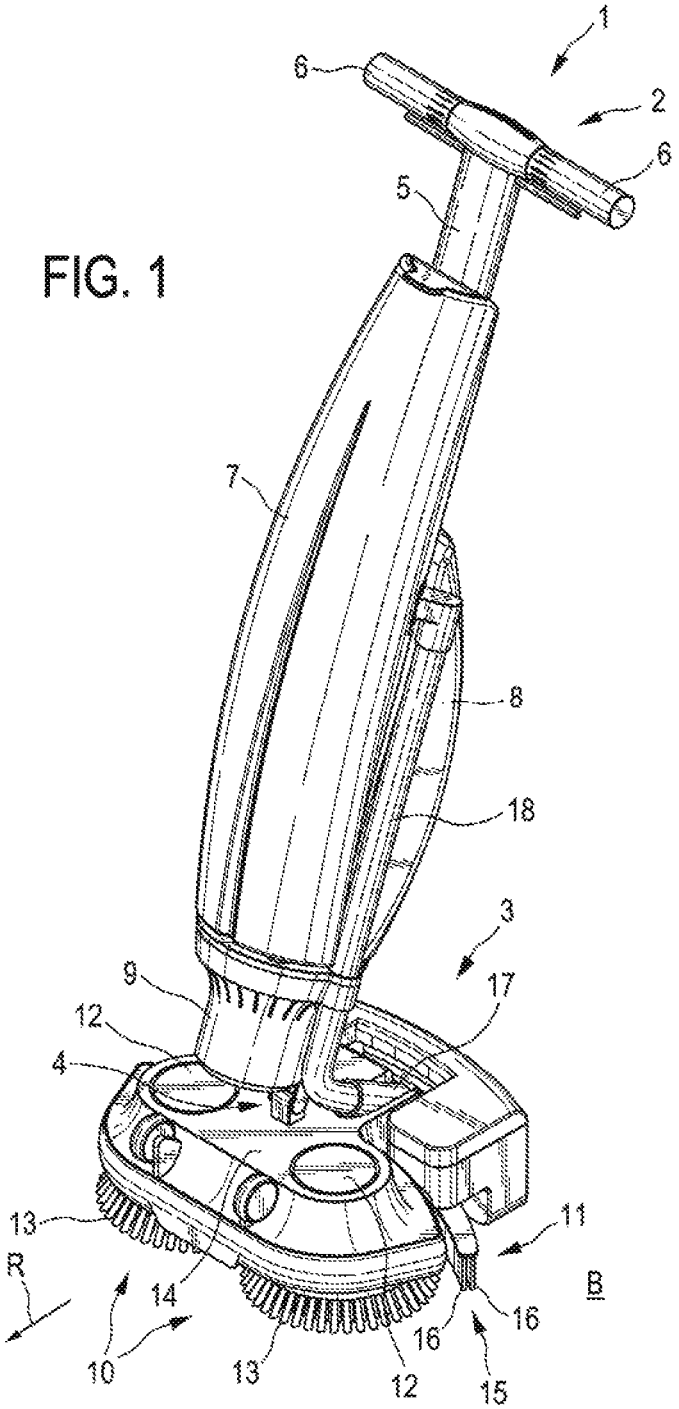
FIG. 1 shows a perspective schematic illustration of a first embodiment of a wet-cleaning apparatus according to the invention.

A wet-cleaning apparatus 1 according to FIG. 1 is designed in the form of a scrubbing/suction machine and is provided for the wet cleaning of a floor surface B. The floor surface B in the present case is a hard floor in a building interior (not illustrated specifically). The wet-cleaning apparatus 1 has a hand-guidance part 2 and a floor part 3. The hand-guidance part 2 is connected for pivoting articulation, by means of a joint arrangement 4 comprising two joint axes (not referred to in any more detail), to the floor part 3. The joint arrangement 4 is arranged at the end of the hand-guidance part 2 and is configured such that, starting from a vertical, the hand-guidance part 2 can be pivoted all around in all directions at different angles relative to the floor part, wherein the hand-guidance part 2 is in torque-transmitting operative connection with the floor part 3 in any of these angular positions. This type of joint connection between the hand-guidance part 2 and floor part 3 is known from EP 2 832 277 B1, reference being expressly made hereby to the relevant disclosure thereof for the purpose of explaining the construction and/or the functioning of the joint arrangement 4. The hand-guidance part 2 is elongate and, in the configuration which can be seen with reference to FIG. 1, projects slightly obliquely upwards from the floor part 3. The hand-guidance part 2 has a central, dimensionally stable carrying tube 5, at the upper end region of which are arranged two handles 6, which project on opposite sides and are intended for manual guidance of the wet-cleaning apparatus 1. The hand-guidance part 2 also has a dirty-water tank 7, which is fastened on the front of the carrying tube 5, and a fresh-water tank 8, which is fastened on the rear of the carrying tube 5. A suction drive 9 is arranged at a lower end region of the carrying tube 5 and serves, in a manner which will be described in more detail hereinbelow, for the suction removal of liquid from the floor surface B.

Figure 2:
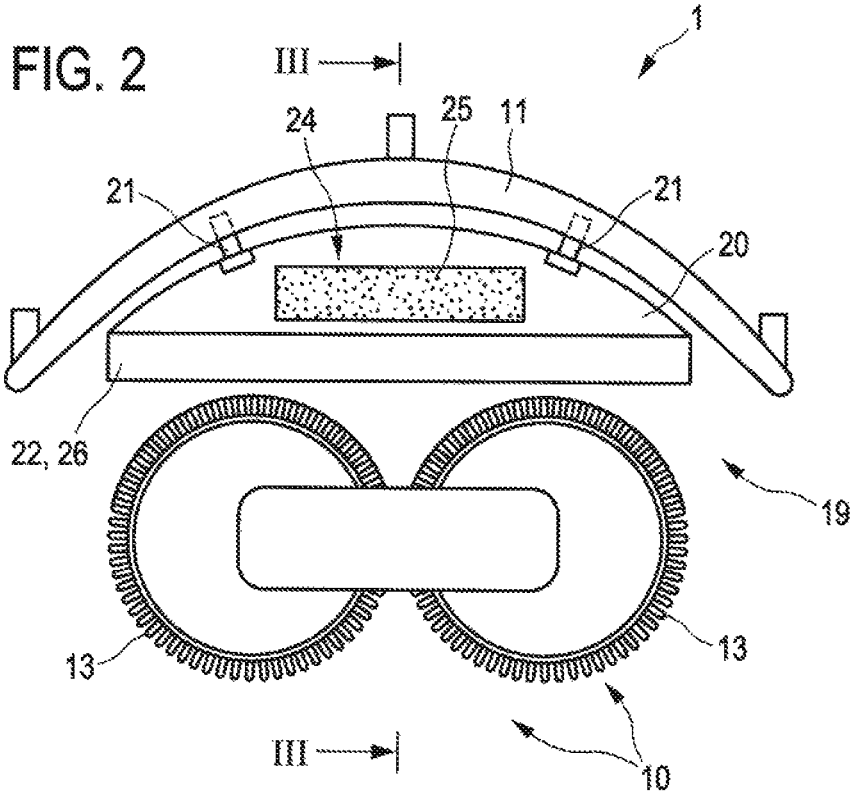
FIG. 2 shows a simplified, schematic plan view of the wet-cleaning apparatus according to FIG. 1 in the region of a pick-up device.

In the operating state which can be seen with reference to FIG. 1, the floor part 3 rests on the floor surface B, and it has a floor-treatment tool 10 and a suction-bar arrangement 11. In the present case, the floor-treatment tool 10 has two disc tools, each designed in the form of a disc brush 13. These can be rotated in opposite directions by means of a respective drive 12 and, in the operating state, at least part of the disc tools establishes contact with the floor surface B. Instead of two drives 12, it is also possible to provide just one drive which is common to the disc brushes 13. The disc brushes 13 are each mounted, in a manner which is known in principle, for rotary movement in a housing 14 of the floor part 3, wherein a respective axis of rotation of the disc brushes 13 is oriented essentially vertically in relation to the floor surface B. In the operating state, the left-hand disc brush 13—as seen in relation to the image plane of FIG. 2—rotates in the counterclockwise direction; the right-hand disc brush 13, in contrast, rotates in the clockwise direction. The floor-treatment tool 10 here is configured such that, in the operating state, there is permanent linear propulsion along a cleaning direction R onto the floor part 3. For this purpose, in the present case, the axes of rotation of the disc brushes 13 (said axes not being referred to in any more detail) are in a state in which they are tilted slightly in relation to one another out of the vertical. During operation of the floor-treatment tool 10, this results in a frictional-force distribution of the disc brushes 13 on the floor surface B which differs around the respective circumference of the disc brushes 13. Consequently, the rotation of the disc brushes 13 in opposite directions provides not just for the floor surface B to be treated, but, in addition, for said permanent linear propulsion along the cleaning direction R. Such a configuration of the floor-treatment tool has already been described in EP 2 832 277 B1. Reference is expressly made hereby to the relevant disclosure of said document for the purpose of providing additional explanation of the propelling function of the floor-treatment tool 10.

The suction-bar arrangement 11 is arranged behind the floor-treatment tool 10 as seen in relation to the cleaning direction R and is provided for the suction removal of liquid from the floor surface B. The suction-bar arrangement 11 has two sealing lips 16, which are spaced apart from one another to form a defined intake slot 15. The intake slot 15 is in operative connection with the dirty-water tank 7 via a suction line 18, in a manner which is known in principle, by means of an intake nozzle 17. In this way, it is possible for the suction drive 9, which is in operative connection with the suction line 18, to take in liquid between the sealing lips 16 and to transport said liquid into the dirty-water tank 7.

For the wet cleaning of the floor surface B, in the present case water is applied to the floor surface B, starting from the fresh-water tank 8, in the region of the floor-treatment tool 10. The water applied can dissolve dirt located on the floor surface B and can assist the scrubbing operation of the disc brushes 13, which rotate in relation to one another. The dirty water produced here is removed by suction by means of the suction-bar arrangement 11 and transported into the dirty-water tank 7 in the manner described above. In the case of the wet cleaning described above, the situation where solid particles, such as dust, hair or relatively small objects, located on the floor surface B are accumulated in the region of the suction-bar arrangement 11 cannot readily be avoided. This can result in the suction performance being impaired and in the sealing lips 16 tending to cause smearing. This can ultimately result in unsatisfactory cleaning.

Figure 3:
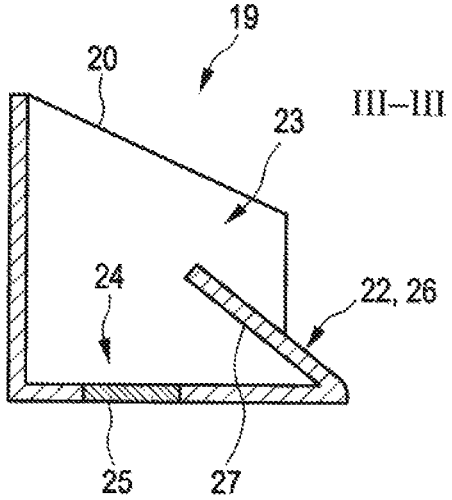
FIG. 3 shows an enlarged detail-specific illustration of a pick-up container of the pick-up device of the wet-cleaning apparatus according to FIGS. 1 and 2, taken along section line according to FIG. 2.

In order to counteract this, the wet-cleaning apparatus 1 has a pick-up device 19 which is arranged between the at least one floor-treatment tool 10 and the suction-bar arrangement 11, as seen in the cleaning direction R. The pick-up device 19 is configured such that solid particles transported to the rear—as seen in relation to the cleaning direction R—by the floor-treatment tool 10 are picked up and collected. Details of the pick-up device 19 can be seen, in particular, with reference to FIGS. 2 and 3. So, the pick-up device 19 has a pick-up container 20 which is provided for picking up and collecting the solid particles (which are not shown specifically). In the present case, the pick-up container 20 extends essentially over the entire width of the floor-treatment tool 10 and is secured on the suction-bar arrangement 11 by means of two fastening elements 21. The fastening elements 21 are configured such that the pick-up container 20 can be easily released from the suction-bar arrangement 11 for emptying and cleaning purposes. In the present case, a rear wall region of the pick-up container 20, as seen in the cleaning direction R, follows a curved contour of the suction-bar arrangement 11. This allows improved utilization of the available installation space. In an end region which is directed towards the floor-treatment tool 10, the pick-up container 20 has a supply element 22. The supply element 22 is arranged between a pick-up opening 23 (FIG. 3) of the pick-up container 20 and the floor-treatment tool 10, as seen in the cleaning direction. The supply element 22 serves to supply the solid particles into the interior of the pick-up container 20 through the pick-up opening 23. In the present case, the supply element is configured in the form of a ramp 22 and is formed in one piece on the pick-up container 20, which is produced preferably from plastic. In the operating state according to FIG. 1, the ramp 22 is positioned at an acute angle in relation to the floor surface B. In addition, the pick-up device 19 has a discharging element 24. The discharging element 24 serves to discharge the liquid picked up in the pick-up container 19. This is because, in the case of the wet cleaning described above, the situation where liquid is thrown up from the floor surface B, and transported into the interior of the pick-up container 19, by means of the rotating disc brushes 13 cannot readily be avoided. In the case of the embodiment according to FIGS. 1 to 3, the discharging element 24 has a liquid-permeable drainage-wall portion 25 of the pick-up container 19. As is depicted schematically with reference to FIG. 2, the drainage-wall portion 25, in the present case, is perforated in the manner of a screen, and therefore said liquid is discharged downwards, in the direction of the floor surface B, out of the interior of the pick-up container 20 and, as the cleaning operation progresses, is sucked up by the suction-bar arrangement 11. In addition, the pick-up device 19 has a restraining element 26. The restraining element 26 functions such that solid particles collected in the pick-up container 20 are reliably held back during the cleaning operation. In the present case, the restraining element 26 has a restraining-wall portion 27 of the pick-up container 20, said wall portion being arranged adjacent to the pick-up opening 23. The restraining-wall portion is configured in the form of an undercut ramp 27, which in the operating state extends at an acute angle relative to the floor surface B.

Figure 4:
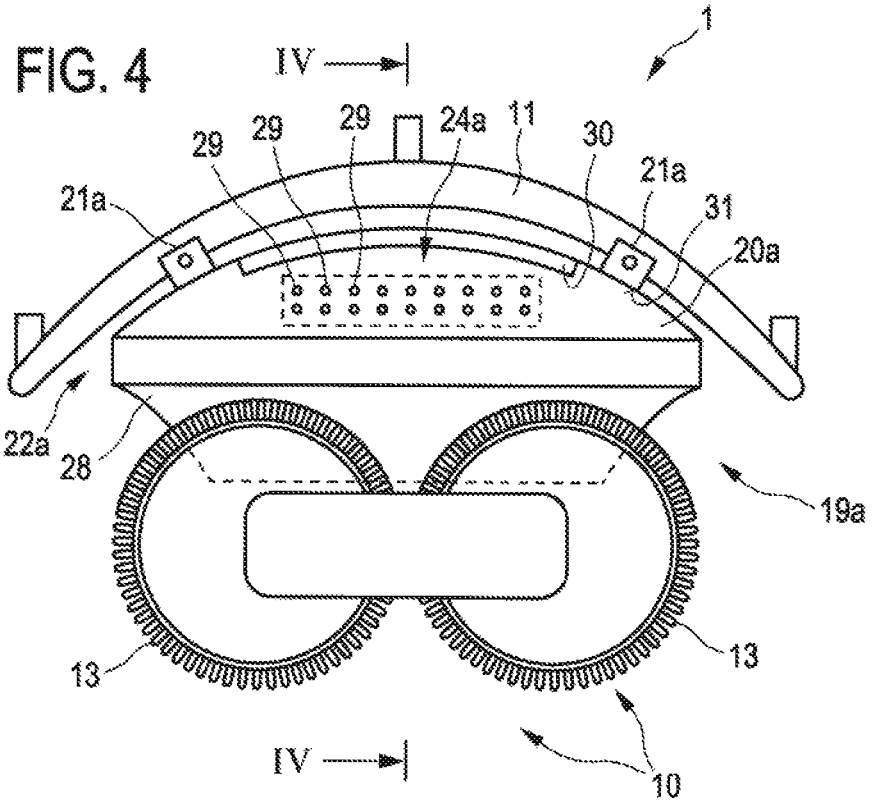
FIG. 4 shows a view corresponding to FIG. 2 of a further embodiment of a wet-cleaning apparatus according to the invention.
Figure 5:
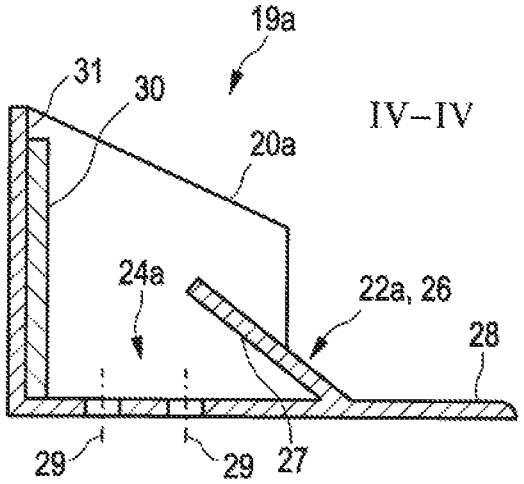
FIG. 5 shows an enlarged detail-specific illustration of a pick-up container of the wet-cleaning apparatus according to FIG. 4, taken along section line IV-IV according to FIG. 4, FIGS. 6 and 7 show an enlarged sectional illustration, corresponding to the illustrations of FIGS. 3 and 5, of further embodiments of pick-up devices configured according to the invention.

Further embodiments of wet-cleaning apparatuses 1*a*, 1*b* and 1*c* according to the invention can be seen with reference to FIGS. 4, 5 and also 9 and 10. As far as their structural and functional features are concerned, the embodiments of wet-cleaning apparatuses 1, 1*a* according to the invention have an essentially corresponding construction. Components and portions which are identical in the case of the wet-cleaning apparatuses 1 to 1*c* are, to that extent, provided with identical reference signs. To avoid repetition, such identical components and portions are not explained separately for each embodiment; rather, reference is made to the relevant disclosure in conjunction with the wet-cleaning apparatus 1. Functionally identical components and portions, which nevertheless differ in design, are denoted by identical reference numerals with lower-case letters added thereto.

The wet-cleaning apparatus 1*a* according to FIGS. 4 and 5 differs merely by way of its pick-up device 19*a* being configured differently to that of the wet-cleaning apparatus 1. Consequently, it is only the significant differences between the pick-up device 19 and the pick-up device 19*a* which will be discussed in more detail. The pick-up device 19*a* has a supply element 22*a* which is provided with a plate-form extension 28. The extension 28 is formed in one piece on the pick-up container 20*a* and extends essentially horizontally. It can be seen with reference to FIG. 4 that the extension 28 extends beneath the floor-treatment tool 10, as seen in the cleaning direction R, and therefore that part of the circumferential region of the disc brushes 13 which is oriented in the direction of the pick-up device 19*a* rests on the extension 28. The extension 28 here provides for an improved supply of solid particles into the pick-up container 20*a*. Also in contrast to the pick-up device 19, the pick-up device 19*a* has a discharging element 24*a*, which has a multiplicity of drainage openings 29 arranged on the pick-up container. Additionally provided is a damping element 30, which is arranged on a rear, inner wall portion 31 of the pick-up container 20*a*, as seen in the cleaning direction R. The damping element 30 is of compliant configuration such that solid particles slung into the pick-up container 20*a* by means of the disc brushes 13 rotating in opposite directions are slowed down, and this therefore avoids the situation where said solid particles bounce off the wall portion 31 and out of the pick-up container 20*a*. Moreover, the pick-up device 19*a* involves a different fastening method on the suction-bar arrangement 11. Fastening elements 21*a* are provided for this purpose. The fastening elements 21*a* are each configured in the form of a link plate and are provided for releasable connection to bolts (not referred to in any more detail) secured on the suction-bar arrangement 11.

Figure 6:
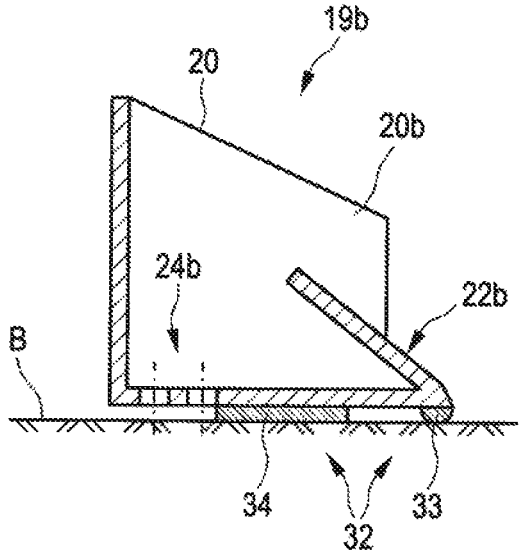
Figure 7:
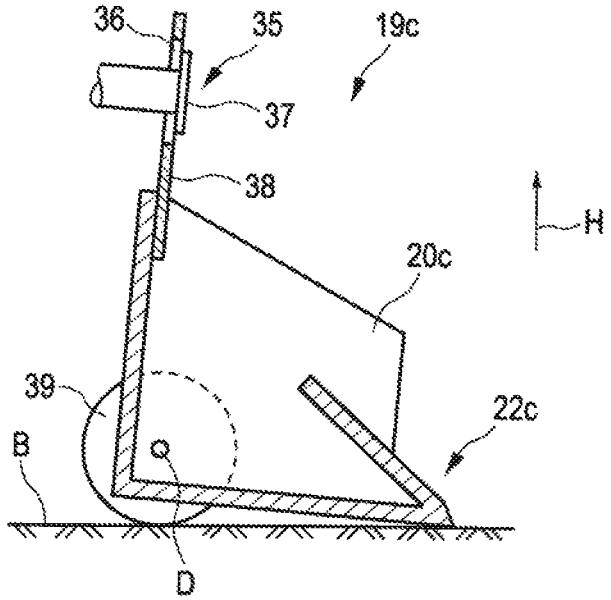
Figure 8:
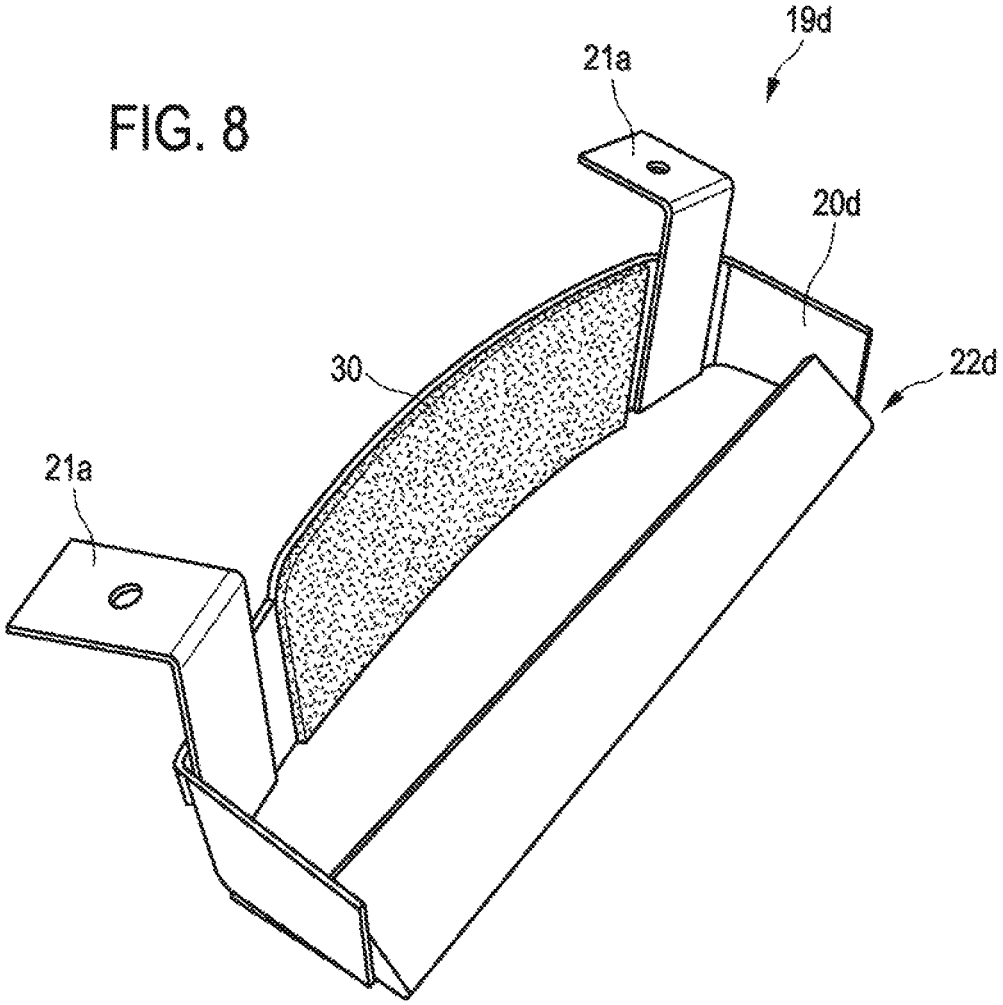
FIG. 8 shows a perspective schematic illustration of a further pick-up device for a wet-cleaning apparatus according to the invention.

Further embodiments of pick-up devices 19*b*, 19*c* and also 19*d* configured according to the invention can be seen with reference to FIGS. 6, 7 and 8. In order to avoid repetition, it is, once again, merely the significant differences between the pick-up devices 19*b* to 19*d* which will be discussed hereinbelow.

The pick-up device 19*b* according to FIG. 6 has a wiper element 32 arranged on the underside of the pick-up container 20*b*. In the present case, the wiper element 32 has a sealing lip 33 and a textile sheet-like structure in the form of a wiper fleece 34. The sealing lip 33 is arranged beneath the supply element 22*b* and at the end, as seen in the cleaning direction R. The wiper fleece 34 is arranged behind the sealing lip 33, and in front of the discharging element 24*b*, as seen in the cleaning direction R. In the operating state which can be seen with reference to FIG. 6, both the sealing lip 33 and the wiper fleece 34 rest on the floor surface B. The wiper element 32 serves to provide improved sealing between the floor surface B and an underside of the pick-up container 20*b* (said underside not being referred to in any more detail). This avoids the situation where solid particles can be transported through beneath the pick-up container 20*b* and can thus be accumulated on the suction-bar arrangement 11.

In contrast to the embodiments described above, the embodiment according to FIG. 7 has at least one guide element 35. The pick-up device 19*c*, more specifically the pick-up container 20*c*, is mounted in a floating manner relative to the suction-bar arrangement 11 and/or the floor-treatment tool 10, as seen in relation to the vertical direction H, by means of the guide element 35. This allows for advantageous adjustment of the pick-up container 20*c* along the floor surface B even in the case of the floor surface B having any unevennesses. For this purpose, in the present case, the guide element has a stay bolt 37 engaging in a slot 36. In the present case, the slot 36 is formed on the pick-up device 19*c*. In contrast, in the present case, the stay bolt 37 is assigned to the suction-bar arrangement 11 and secured thereon. The slot 36 here is formed on a link plate 38, which is arranged on a rear, inner wall portion of the pick-up container 20*c*, as seen in the cleaning direction R. It is possible for the link plate 38 to be formed in one piece on the pick-up container 20*c* or, in the form of a separately produced component, to be joined together with the pick-up container 20*c*. The latter scenario applies in the present case. In addition, the pick-up device 19*c* has a supporting element 39. The supporting element 39 serves to support the pick-up container 20*c* with rolling action on the floor surface B. For this purpose, the supporting element is designed in the form of a supporting wheel 39 which is secured on the pick-up container 20*c* for rotary movement about an axis of rotation D. The axis of rotation D is arranged in a portion of the pick-up container 20*c* which is directed towards the suction-bar arrangement 11 and is at the rear, as seen in the cleaning direction R. In the operating state which can be seen with reference to FIG. 7, the to that extent eccentric support means that the pick-up container 20*c* is in a state in which it is tilted forwards in the direction of the floor-treatment tool and, on a lower region of the supply element 22*c*, is supported with sliding action on the floor surface B.

The pick-up device 19*d* configured according to the invention, which can be seen with reference to FIG. 8, is essentially identical to the pick-up device 19*a* according to FIG. 5. In contrast to the latter, the pick-up device 19*d*, however, does not have a plate-form extension 28. The damping element 30 is produced from a knitted fibre material (not referred to any more specifically).

Figure 9:
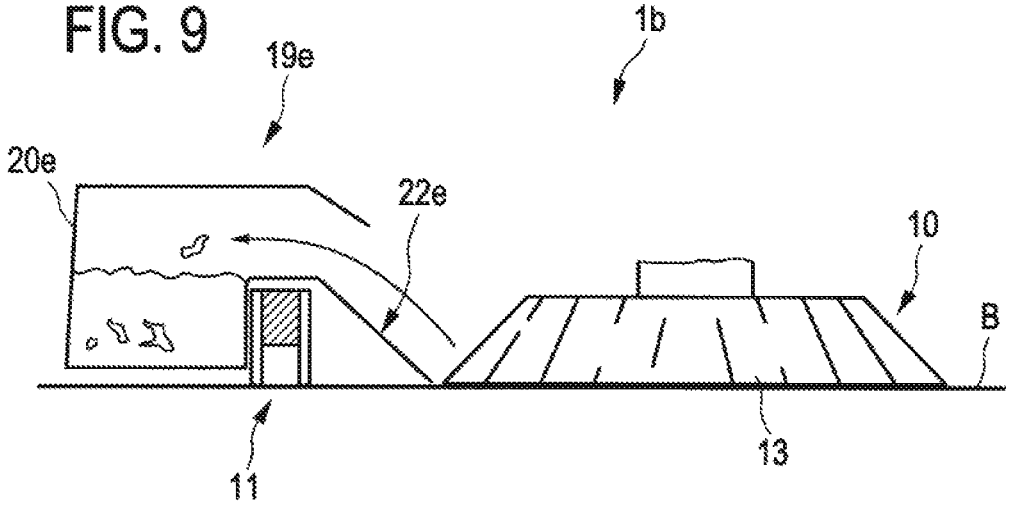
FIG. 9 shows a schematically highly simplified side view, in partially cut-away form, of a further embodiment of a wet-cleaning apparatus according to the invention.

The wet-cleaning apparatuses 1 and 1*a* have in common the fact that the pick-up devices 19, 19*a* there, and also 19*b* and 19*c*, are arranged essentially in their entirety between the floor-treatment tool 10 and the suction-bar arrangement 11, as seen in the cleaning direction R. In contrast to this, the wet-cleaning apparatus 1*b* according to FIG. 9 provides for merely part of the pick-up device 19*e* there to be arranged between the floor-treatment tool 10 and the suction-bar arrangement 11. It can be seen with reference to FIG. 9 that the pick-up container 20*e* of the pick-up device 19*e* is arranged behind the suction-bar arrangement 11, as seen in the cleaning direction R, wherein, starting from the pick-up container 20*e*, the supply element 22*e* extends forwards, in the direction of the floor-treatment tool 10, beyond the suction-bar arrangement 11 and obliquely downwards, in the direction of the floor surface B. As a result, the solid particles, which are indicated schematically with reference to FIG. 9 but are not referred to in any more detail, are transported beyond the suction-bar arrangement 11 and into the interior of the pick-up container 20*e* along the path depicted by an arrow.

Figure 10:
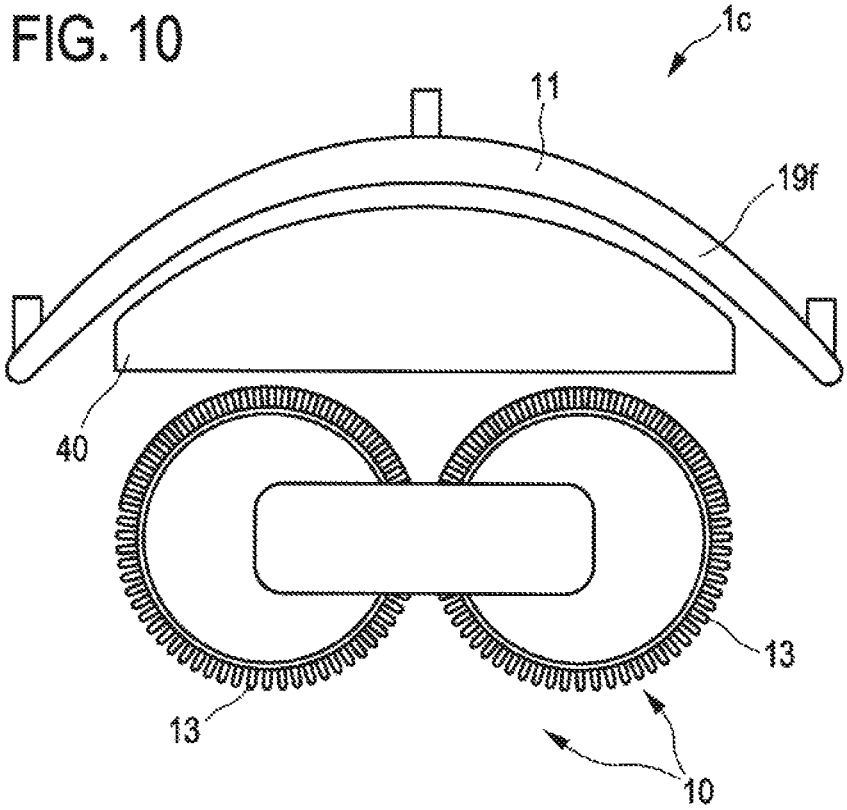
FIG. 10 shows a view corresponding to FIGS. 2 and 4 of a further embodiment of a wet-cleaning apparatus according to the invention.

A further wet-cleaning apparatus 1*c* configured according to the invention can be seen with reference to FIG. 10. In contrast to the wet-cleaning apparatuses 1 to 1*b* described above, the pick-up device 19*f* of said wet-cleaning apparatus 1*c* does not have a pick-up container. Instead, the pick-up device 19*f* has a receiving element 40, at least part of which rests, in the operating state, on the floor surface B and which is configured such that solid particles transported to the rear by the floor-treatment tool 10 can be picked up and collected on and/or in the receiving element. For this purpose, in the present case, the receiving element is designed in the form of a cleaning fleece 40. It is possible for the cleaning fleece 40 to be produced, in particular, from fibres and/or to be of a sponge-like design.

Of course, it is also possible for the large number of structural and functional features of the pick-up devices 19 to 19*f* described above to be embodied in a single pick-up device configured according to the invention, as long as it is technically expedient for these features to be combined. In particular the features of the pick-up devices 19 to 19*c* can be provided in their entirety, or in appropriate sub-combinations, on a pick-up device configured according to the invention.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A wet-cleaning apparatus for wet cleaning of a floor surface, comprising:

a floor part, which in an operating state rests on the floor surface, a hand-guidance part, which is connected for pivoting articulation, about at least two joint axes, to the floor part, and is in torque-transmitting operative connection with the floor part, at least one floor-treatment tool, which is arranged on the floor part and has two disc tools, which in the operating state rest on the floor surface, are rotatable in opposite directions by at least one drive and are arranged such that, in the operating state, there is permanent linear propulsion along a cleaning direction onto the floor part, a suction-bar arrangement, which is arranged behind the floor-treatment tool viewed in relation to the cleaning direction, for suction removal of liquid from the floor surface, and a pick-up device, which is arranged between the at least one floor-treatment tool and the suction-bar arrangement, the pickup device being configured to pick up and collect solid particles transported rearwardly by the floor-treatment tool.

2. The wet-cleaning apparatus according to claim 1, further comprising:

a guide element by which the pick-up device is mounted in a floating manner relative to the suction-bar arrangement and/or the floor-treatment tool, as seen in a vertical direction.

3. The wet-cleaning apparatus according to claim 2, wherein the guide element has at least one stay bolt engaging in a slot.

4. The wet-cleaning apparatus according claim 1, wherein the pick-up device has a pick-up container which picks up and collects the solid particles.

5. The wet-cleaning apparatus according to claim 4, wherein the pick-up device has a supply element which is arranged between a pick-up opening of the pick-up container and the at least one floor-treatment tool, as seen in the cleaning direction, and supplies the solid particles to the pick-up opening.

6. The wet-cleaning apparatus according to claim 5, wherein the supply element has a plate-form extension of the pick-up container.

7. The wet-cleaning apparatus according to claim 4, wherein the pick-up device has a supporting element which supports the pick-up container, in the operating state, on the floor surface.

8. The wet-cleaning apparatus according to claim 4, further comprising:

a wiper element in the form of a sealing lip and/or a textile sheet-shaped structure, arranged on an underside of the pick-up container.

9. The wet-cleaning apparatus according to claim 4, wherein the pick-up device has at least one discharging element which discharges liquid picked up in the pick-up container.

10. The wet-cleaning apparatus according to claim 9, wherein the discharging element has one or both of: at least one drainage opening, which is arranged on the pick-up container, and at least one liquid-permeable drainage-wall portion of the pick-up container.

11. The wet-cleaning apparatus according to claim 4, wherein the pick-up device has a restraining element which holds back the solid particles collected in the pick-up container.

12. The wet-cleaning apparatus according to claim 11, wherein the restraining element has a restraining-wall portion of the pick-up container, said wall portion being adjacent to a pick-up opening of the pick-up container.

13. The wet-cleaning apparatus according to claim 12, wherein the restraining-wall portion is configured in the form of a ramp which, in the operating state, extends at an acute angle relative to the floor surface.

14. The wet-cleaning apparatus according to claim 1, wherein the pick-up device has a receiving element, at least part of which rests, in the operating state, on the floor surface.

15. The wet-cleaning apparatus according to claim 3, wherein the slot is formed on the pick-up device and the stay bolt is connected to the suction-bar arrangement.

16. The wet-cleaning apparatus according to claim 13, wherein the restraining-wall portion is configured in the form of an undercut ramp.

* * * * *